United States Patent [19]

Goncalves

[11] Patent Number: 4,705,053

[45] Date of Patent: Nov. 10, 1987

[54] COSMETIC CONTAINER HAVING VARIABLE PRODUCT TAKE-UP

[75] Inventor: Antonin Goncalves, Groslay, France

[73] Assignee: The French Joint Stock Company "L'Oreal", Paris, France

[21] Appl. No.: 729,147

[22] Filed: Apr. 30, 1985

[30] Foreign Application Priority Data

May 7, 1984 [FR] France ..... 84 07059
Apr. 17, 1985 [FR] France ..... 85 05773

[51] Int. Cl.[4] ..... A45D 40/26

[52] U.S. Cl. ..... 132/88.7; 401/122; 401/129

[58] Field of Search ..... 132/88.7, 88.5; 401/129, 122, 121

[56] References Cited

U.S. PATENT DOCUMENTS

| | | | |
|---|---|---|---|
| 3,861,810 | 1/1975 | Vasas | 401/122 |
| 3,930,280 | 1/1976 | Vasas | 401/122 |
| 3,998,235 | 12/1976 | Kingsford | 132/88.7 |
| 4,194,848 | 3/1980 | Kingsford | 132/88.7 |
| 4,261,376 | 4/1981 | Kingsford | 132/88.7 |
| 4,332,494 | 6/1982 | Kingsford | 132/88.7 |
| 4,407,311 | 10/1983 | Queret | 132/88.5 |
| 4,411,282 | 10/1983 | Wavering | 132/88.5 |

FOREIGN PATENT DOCUMENTS

| | | | |
|---|---|---|---|
| 2301 | 6/1979 | European Pat. Off. | 401/122 |
| 3240151 | 5/1984 | Fed. Rep. of Germany . | |
| 1339943 | 9/1963 | France . | |
| 2545008 | 11/1984 | France | 401/122 |
| 262515 | 1/1982 | Spain . | |

*Primary Examiner*—Robert P. Swiatek
*Assistant Examiner*—Cary E. Stone
*Attorney, Agent, or Firm*—Cushman, Darby & Cushman

[57] ABSTRACT

A make up unit comprises a container for mascara, a cap, and a stem carrying a brush which penetrates into the container via a passage axially traversing a wiper element. The wiper element has a wiping zone defining a passage whose cross section is smaller than that of the brush in its state of rest. The wiper element is formed by a lip whose internal edge defines the brush-receiving passage and is joined at its periphery to a ring of a greater thickness, which can sustain, by an axial compression exerted on it, an elastic deformation leading to a variation of the cross-section of the passage. An adjuster ring controls the compression and a reservoir of mascara is accommodated in a barrel. Thus the degree of compression of the wiper element can be adjusted and, as a result, the force of the wiping action will be adjusted.

23 Claims, 8 Drawing Figures

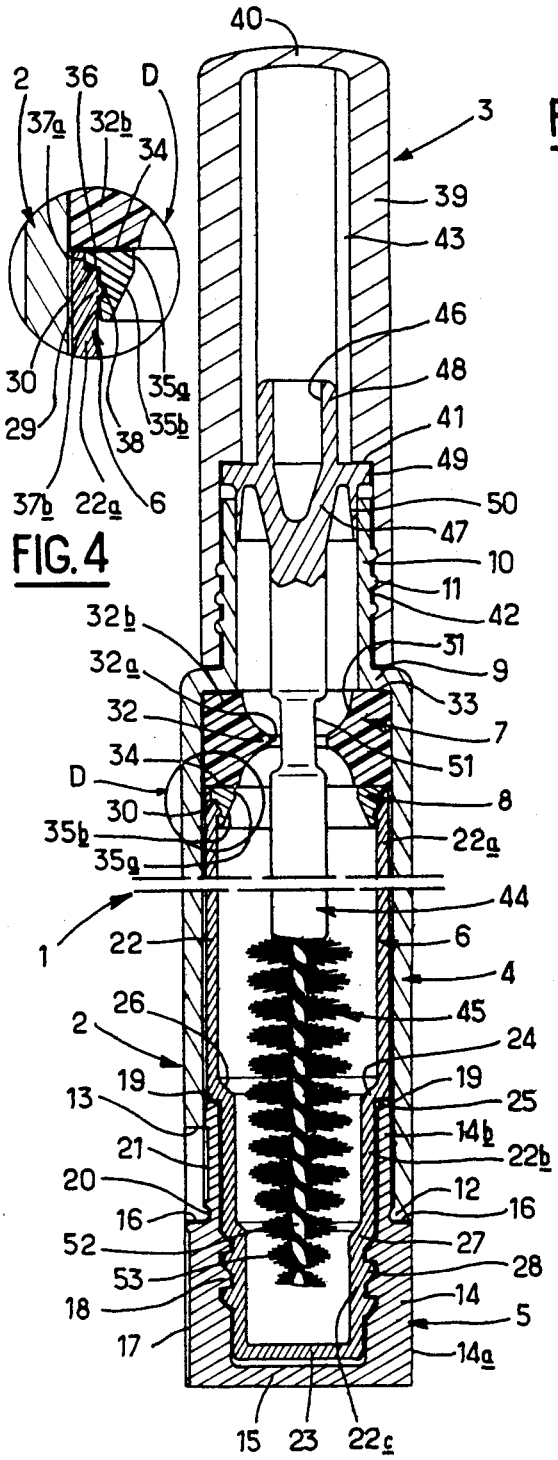
FIG. 4
FIG. 1
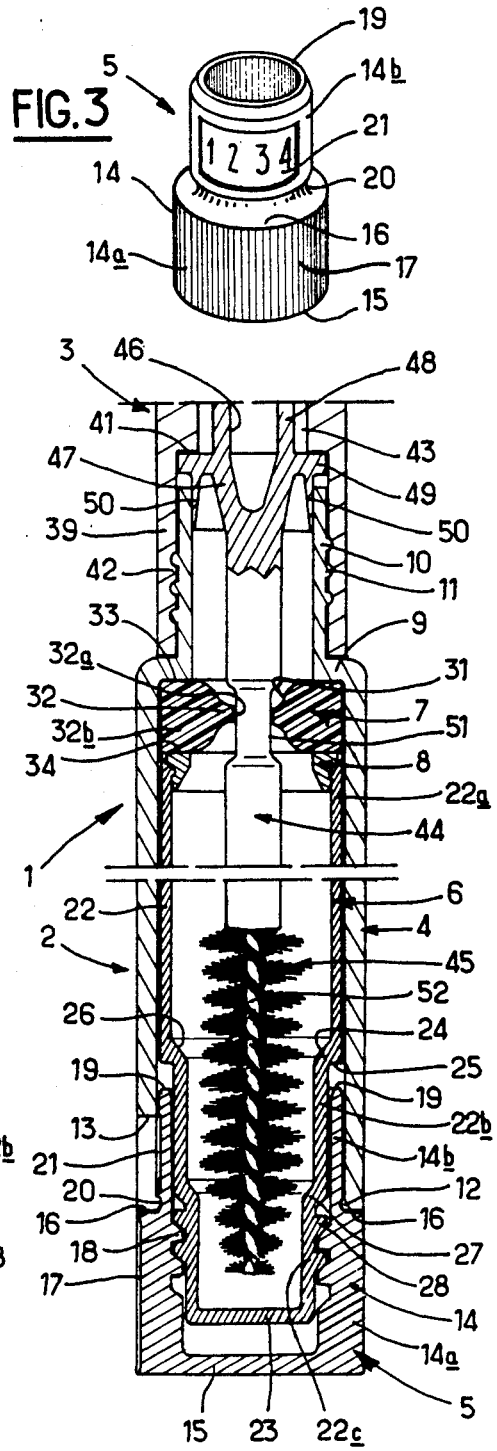
FIG. 3
FIG. 2

COSMETIC CONTAINER HAVING VARIABLE PRODUCT TAKE-UP

The present invention relates to a make up unit intended more particularly for the making up of eyelashes by means of a lash highlighting product, also called mascara, this make up unit allowing the user to take up a selected quantity of the make up product on each application, according to need.

A conventional mascara applicator comprises a container for the mascara and a detachable cap which is intended to close the container and which constitutes a handle for manipulating a brush carried by the end of a stem integral with the cap. In the closed position of the container, the stem and the brush with which it is associated, penetrate into the container. When the stem is withdrawn from the container, a certain quantity of mascara is taken up on the brush which can then be applied to the lashes.

The brush generally penetrates inside the container through a substantially circular opening edged by a single lip whose function is to exert a wiping action on the bristles of the brush with a view to eliminating the excess of make up product taken up by the brush within the container. The diameter of this circular opening must be smaller than the minimum diameter of the brush measured at the tip of the bristles so that the pliable lip around the orifice can wipe the brush as it is being withdrawn from the container.

It will be found that with this conventional structure of the wiper lip, the quantity of mascara retained by the brush on each extraction of the stem from the container is substantially always the same. Now, the fact that the user cannot control the quantity of mascara retained by the brush on each occasion frequently represents a constraint for him or her. In fact, making up the lower lashes generally requires less mascara than the upper lashes; moreover, the quantity of mascara applied during one make up operation depends on the nature of the lashes to be made up, as well as the type of make up desired. Thus, on the one hand, the lashes to be made up may be larger or shorter than average, thicker or thinner than average, or closer together or further apart than average, and, on the other hand, the user may wish to obtain a heavier or lighter make up than average with a variable separation of the lashes.

To facilitate the lash make up movements, means has therefore been sought to allow the user to control the mascara quantity collected at each making up, for instance, in order to avoid the user wishing to obtain a light make up or a make up of the lashes of the lower lid having a brush which is overloaded with mascara, or a user wishing to obtain a thick make up or a make up of the upper lashes having to reimmerse the brush carrier stem constantly in the container.

Thus it has been proposed in the European Pat. No. 0 002 301 to cause the area of the transverse cross-section of the opening arranged for the passing of the brush through the wiper element to vary or, as an alternative, to replace the opening by another having a different transverse cross sectional area. Thus, for a maximum transverse cross-section of the opening, a weak wiping action is obtained corresponding to a brush more heavily charged with the make up product and for a minimum transverse cross-section of this opening, the more pronounced wiping action corresponds to a brush less charged with the make up product.

Various embodiments for the wiper element suited to ensure this function have been indicated in the above mentioned European patent. However, these embodiments rely on rather complicated wiper elements necessitating a complete modification of the structure of the mascara container with a view to their being fitted in its brush-receiving opening, and/or on wiper elements which, being by definition made of a pliable material to allow them to perform the wiper function, are subjected to helical turning, torsional or bending deformation to obtain an exit passage for the brush having a variable cross-sectional area, thus entailing the risk of very rapid wear. Moreover, in certain embodiments, the adjustment of the mascara quantity retained by the brush may be considered to be imperfect, or the quantity taken up on a brush for one application cannot be uniformly distributed over the brush periphery.

The present invention allows the above mentioned drawbacks to be overcome. For this purpose, it proposes a wiper element comprising a single wiper lip of an annular shape, whereon no stress is exerted when the user is called upon to modify the cross-section of the circular opening edged by this lip, by acting on an appropriate means of control. The modification of this cross-section is effected by a uniform compression of a relatively thick ring to which the wiper lip is joined at its periphery. From this it follows that, on the one hand, the risk of damaging the wiper element during the various manipulations for modifying the cross-section of the opening edged by the wiper lip is zero and, on the other hand, this opening remains substantially circular whatever its chosen cross-sectional area. Thus, to the advantage of a simple structure, there is added that of a functioning giving every satisfaction. Moreover, the general shape of the wiper element according to the present invention remains similar to that of the conventional wiper elements, so much so that the eyelash make up device may have a structure which does not differ substantially from the conventional structure of these devices.

In accordance with a preferred embodiment of the present invention, the above mentioned means of control is constituted by an adjuster ring disposed at the base of the container. Turning of this ring, constituting a very simple movement on the part of the user, lifts a reservoir whose upper edge comes to compress the wiper element as previously indicated, this element and the reservoir both being accommodated in a barrel whose upper portion comprises the usual means for fixing the detachable cap holding the brush carrier stem.

It will, moreover, be pointed out that the adjustment of the diameter of the opening edged by the wiper lip in accordance with the invention is extremely reliable, particularly in view of the fact that one can cause the above mentioned adjuster ring to turn over a relatively wide angle.

Finally, the unit according to the present invention has the additional advantage that it can be made from elements which are easily obtained by moulding, easily assembled and do not pose any problems as regards obtaining the required seal.

Thus the present invention provides a make up unit, for eyelashes in particular, comprising: a container containing a fluid or pasty make up product; a detachable cap fitted on the container; a stem integral with the cap, disposed substantially along its axis and projecting in relation to the cap; a brush carried at the end of the stem which is remote from the cap as an extension of the said stem; and a wiper element disposed at the inlet of the container into which the brush penetrates axially via a passage delimited by the internal edge of a wiper lip made of an elastic material, the wiper zone defined by the above mentioned passage having a cross-section $S_0$ smaller than the cross-section S of the brush in its state of rest, the wiper lip being joined at its periphery to a ring of elastic material having a greater thickness than the said lip and constituting with it the wiper element, the said wiper element being capable of sustaining an elastic deformation leading to a variation of cross-section $S_0$ of the passage intended for th brush, under the actuation of control means which causes a variation in axial compression of said ring.

It is preferable for the wiper element to be constituted by a single component near whose central transverse plane the wiper lip is disposed. In a particular embodiment, the wiper lip is joined to the end plane of the ring by curved sides whose concavity is directed towards the axis of the passage provided for the brush.

Advantageously the container is constituted by a movable element and a fixed element between which the ring of the wiper element is interposed, the movable element being capable of axial translation in relation to the fixed element and being connected to the control means; the fixed element of the container is constituted by a tube connected, at its end remote from that cooperating with the control means, to a neck comprising means which are complementary to the means carried by the cap for fitting the cap on the neck, the connection of the said tube and of the neck constituting an angular shoulder, against which the wiper element bears; the movable element of the container carries internally along its upper edge, a thrust ring ensuring a seal between the said movable element and the wiper element and distributing the compressive force applied against the ring of the said wiper element; the passage delimited by the wiper lip when the wiper element is in its unstressed state, has a cross-section $S_0$ equal to, or slightly smaller than that of the portion of the brush carrier stem which penetrates into the container; the stem of the brush has a reduced cross-section in its zone which, in the position when the cap is fitted on the container, is situated in the passage of the wiper element.

In a first embodiment, the movable element of the container is constituted by a reservoir whose upper edge exerts a thrust on the wiper element; the fixed element of the container is constituted by the wall of a barrel surrounding the above mentioned reservoir; the cylindrical base of the reservoir carries externally a thread cooperating with a complementary internal thread of an adjuster ring, the said adjuster ring constituting the control means and being mounted integrally for translation with the barrel. The barrel can comprise, along its edge remote from the wiper element, an engagement bead for the adjuster ring.

In a second embodiment, the movable element of the container is constituted by a reservoir whose upper edge exerts a thrust on the wiper element; the fixed element of the container is constituted by the wall of a barrel surrounding the reservoir; an adjuster ring constituting the control means cooperates via a thread with the barrel in the zone of the container which is remote from that receiving the cap, the said adjuster ring abutting the bottom of the reservoir. Preferably, the adjuster ring constitutes a cylindrical cup whose bottom has, on a coaxial portion within the cup, a projecting male thread, the said male thread cooperating with a female thread integral with the barrel and disposed along the axis of the said barrel, the end of the male thread abutting the bottom of the reservoir. Advantageously, the female thread of the barrel is carried by the bottom of a sleeve which is fixed on that one of the ends of the barrel which does not accommodate the cap, said one end being open.

Advantageously, the make up unit in accordance with the present invention comprises means indicating the degree of compression exerted on the wiper element.

Thus, in the case of the above mentioned first embodiment, the adjuster ring may penetrate inside the barrel by a cylindrical wall comprising on its external surface a succession of radially disposed marks which appear in turn in a window of the barrel when the adjuster ring is being turned. These marks may in particular be impressed by means of the technique known as hot marking.

However, in accordance with the present invention, one may rely on less expensive means of marking than those used in the hot marking technique. Thus in the case where the container of the make up unit in accordance with the present invention is constituted by a movable element and by a fixed element, the movable element being connected to an adjuster ring constituting the means of control, the means indicating the degree of compression of the wiper element may comprise:

Firstly, a first mark formed by an opening cut in the lateral wall of one of the two portions constituting, on the one hand, the fixed element, and on the other hand, the adjuster ring, the said opening letting appear a subjacent element having a colour different from that of the part carrying the first mark;

Secondly, several second marks each formed by an opening in the lateral wall of that one of the two above mentioned parts which does not carry the first mark, the said opening allowing a subjacent element to appear which has a colour different from that of the part carrying the second marks, each one of the said second marks being capable of coming to be opposite the first mark for a given position of the adjuster ring.

Preferably, the fixed element comprises the opening forming the first mark and the adjuster ring comprises the openings forming the second marks.

Preferably the openings forming the second marks have various shapes and/or sizes. It is desirable for the shapes and/or sizes of the openings forming the second marks to be associated with the state of compression of the wiper element. Thus the openings forming the second marks may have circular shapes whose diameter is associated with section $S_0$ of the wiper element.

In a particular mode of embodiment of the unit according to the present invention, the axes of the openings forming the second marks are disposed in the same plane perpendicular to the axis of the adjuster ring.

Advantageously there are three of said openings forming the second marks.

In the case where the movable element of the container is constituted by a reservoir whose upper edge exerts a thrust force on the wiper element, the fixed element is constituted by the wall of an outer barrel surrounding the reservoir, capable of accommodating the cap at one of its ends and carrying at its opposite end a sleeve whose base comprises a thread cooperating with a complementary thread carried by the base of the adjuster ring and whose free end bears against the reservoir base, provision will advantageously be made for the sleeve to have a different colour from the colour(s) of the adjuster ring and the barrel, thereby constituting the subjacent element forming, together with the elements cut respectively in the barrel and the ring, the respective first and second marks.

In the above mentioned case, and also in the case where it is the fixed element which comprises the opening forming the first mark, whilst the adjuster ring comprises the openings forming the second marks, the opening forming the first mark is advantageously constituted by a cut out of one edge of the barrel on the end remote from that receiving the cap, the sleeve carrying a protuberance capable of being accommodated in the said cut out.

In a particular embodiment of the present invention, the lateral walls of the barrel and of the adjuster ring are flush with one another.

So that the invention may more readily be understood, there will be described below three embodiments represented in the accompanying drawings, by way of a purely illustrative and non-restrictive example.

In these drawings:

FIG. 1 is a partial axial cross-sectional view on an enlarged scale, of the above mentioned first embodiment of make up unit, the cap being fitted on the container and the wiper element being in an unstressed state;

FIG. 2 is a view similar to FIG. 1 showing the same make up unit, the cap occupying the same position in relation to the container as in FIG. 1 but being only partially shown, and the wiper device being in a compressed state;

FIG. 3 is a perspective view of the ring allowing the wiping intensity to be adjusted for the make up unit of FIGS. 1 and 2;

FIG. 4 is a view on an enlarged scale of detail D of FIG. 1;

Figure 8:
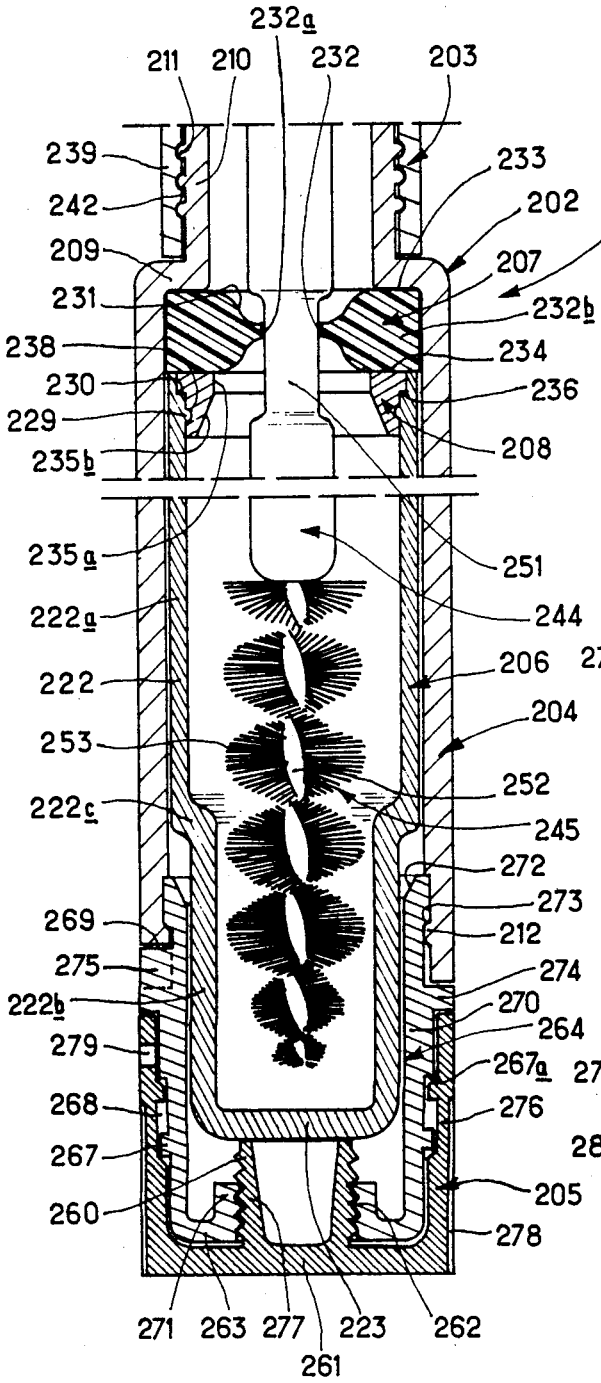
Figure 7:
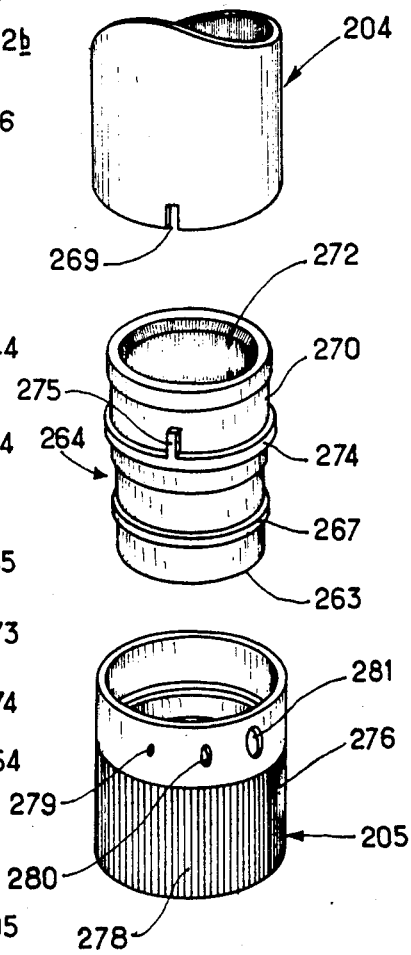

FIG. 7 is a view in an exploded perspective on an enlarged scale showing the sleeve adjuster ring and the bottom end of the barrel of the above mentioned third mode of embodiment of make up unit; and FIG. 8 is a partial, axial cross-sectional view of the make up unit of FIG. 7 on an even more enlarged scale, the cap being fitted on the container and the wiper element being under maximum axial compression.

Referring to FIGS. 1 to 4, there will be seen a make up unit 1 used for applying mascara to eyelashes. Unit 1, in a closed position, such as may be seen in FIG. 1, takes the form of a stick resulting from assembling a cylindrical container 2 with a cylindrical cap 3 of slightly smaller external diameter than container 2.

Container 2 is itself constituted by an outer barrel 4 having at its bottom end a ring 5 for adjusting the wiping intensity, the barrel 4 and ring 5 defining an internal space housing a mascara reservoir 6 surmounted by a wiper element 7 with the interposition of a thrust ring 8.

The barrel 4, made of a plastic material such as polypropylene, consists of a cylindrical tubular element open at its two ends. At its upper end, the barrel 4 comprises an annular shoulder 9 beyond which it has a smaller diameter so as to constitute a neck 10 carrying an external thread 11. At its lower end, the internal wall of barrel 4 comprises a fastening bead 12 whose function will be indicated below. Moreover, it has at its lower edge a cut out defining a window 13 whose function is also indicated below. This window 13 is delimited by two opposite edges of the same height disposed along generatrices of barrel 4 at a short peripheral distance from each other.

The adjuster ring 5 closing the barrel 4 at its lower portion is made of a plastic material, such as a shock resistant polystyrene. It is constituted by a cylindrical sleeve 14 joined to a base 15. The external wall of sleeve 14 has substantially, at mid height, an annular radial set back 16, beyond which it has a reduced thickness. The larger external diameter lower portion **14*a* of the sleeve 14 has a greater thickness than that of base 15; moreover, it comprises externally and over a whole of its periphery, axial striations 17, and internally a thread 18. As for the upper portion 14*b* of sleeve 14, it terminates in a rounded edge 19 and it has externally an annular groove 20 whose lower edge is situated in the same plane as that of set back 16. Moreover, the portion 14*b* of sleeve 14 has a shallow recessed zone 21 delimited by two transverse edges disposed along generatrices of the sleeve 14 and by two longitudinal edges disposed in transverse planes of the said sleeve 14, the lower longitudinal edge being next to the upper edge of groove 20. The recessed zone 21 carries indicia, for example numerals ranging from 1 to 4, disposed parallel to the longitudinal edges of the said zone 21, these indicia appearing for instance on a thin sheet bonded to the floor of recessed zone 21**.

In the assembled position of unit 1, the adjuster ring 5 is inserted by the upper portion **14*b* of its sleeve 14 into the barrel 4 whose bead 12 ensures the translational hold by penetrating into groove 20 of the said sleeve 14, while leaving the ring 5 free to rotate around the axis of unit 1**.

The reservoir 6 enclosed by the barrel 4 and ring 5 is made of a plastic material such as polypropylene and consists of a tubular sleeve 22 which is joined at its base to a bottom panel 23 and is open at its upper portion. Between its free edge and its bottom panel 23, the tubular sleeve 22 comprises successively a cylindrical portion **22*a* whose external diameter is slightly smaller than the internal diameter of the barrel 4, then a cylindrical portion 22*b* with a smaller diameter, and finally a cylindrical portion 22*c* with a still smaller diameter. Portions 22*a* and 22*b* are joined via an annular set back 24 arranging an external annular bearing surface 25 and having a frusto-conical internal surface 26 flaring towards the free opening of reservoir 6. As for portions 22*b* and 22*c*, they are joined by a frusto-conical shoulder 27, flaring in the same direction as surface 26. Portion 22*c* carries externally a thread 28 intended to cooperate with the internal thread 18 of sleeve 14 of the adjuster ring 5**.

Near its free edge, the internal wall of portion **22*a* of the reservoir 6 has an annular bead 29 (FIG. 4) above which is a radially outward set back 30**.

The wiper element 7 is made of rubber and consists of a cylindrical element having a central hour glass-shaped duct 31 with a symmetry of revolution in relation to the axis of the said cylindrical element, as well as a central plane of symmetry perpendicular to the said axis. Thus there is constituted in this central plane of symmetry a wiper lip 32 whose inner edge defines a passage 32*a* arranged for the make up brush described below, this wiper lip 32 being, at its periphery, joined to a ring 32*b* of a thickness approximately five times greater than that of the lip 32 when the wiper element 7 is in the unstressed state shown in FIG. 1.

In its assembled position, the upper annular face 33 of the wiper element 7 bears against the internal side of shoulder 9 of barrel 4, the internal diameter of this annular face 33 being slightly smaller than the internal diameter of neck 10 and, by its lower annular face 34 both against the upper surface of ring 8 and the free edge of reservoir 6.

Ring 8, made of a plastic material such as polypropylene, comprises an internal cylindrical wall at its upper portion 35*a*, when considered in its assembled position, and is then frusto-conical at its lower portion 35*b*, flaring in a direction away from the transition zone with the cylindrical portion 35*a*. It has an external cylindrical wall with a radial set back 36 situated substantially at the level of the transition zone of portions 35*a* and 35*b* and sharing the external wall in two zones 37*a* and 37*b*, the smaller diameter lower zone 37*b* having an annular groove 38 intended to cooperate with the annular bead 29 of reservoir 6, and the set back 36 bearing against set back 30 of the reservoir 6 in the assembled position.

Cap 3 is made of a plastic material of the acrylonitrilebutadiene-styrene type. It is constituted by a cylindrical skirt 39 joined to a top panel 40. At some distance from its free edge the skirt 39 comprises an internal set back 41 of its wall, beyond which set back it has a smaller thickness. The smaller thickness end portion comprises an internal thread 42 intended to cooperate with the thread 11 of neck 10 of container 2. Moreover, the greater diameter portion of skirt 39 has internally two diametrically opposed axial ribs 43.

Cap 3 carries an axially extending stem 44 made of a plastic material such as polypropylene and terminated by a brush 45. The stem 44 projects in relation to the cap 3. It is composed of a main cylindrical element whose external diameter, starting near its upper end, progressively increases and then becomes constant again. Its upper wall has an axial cut out 46 so that the main cylindrical element is, at its upper portion, joined by a frusto-conical wall 47 to a cylindrical end portion 48. Stem 44 comprises, at the transition between walls 47 and 48, an external annular flange 49, intended to bear against the set back 41 of the internal wall of the skirt 39 and having on the opposite side to cylindrical wall 48, a slightly frusto-conical lip 50, flaring from the said flange 49 and thinning out towards its free end.

Moreover, the cylindrical portion 48 has, diametrically opposite each other, two axial grooves, (not designated by any reference numbers) to receive the ribs 43 when the stem 44 is fitted to the cap 3.

The main element of stem 44 has, moreover, a constriction 51 of its cross-section over a height corresponding substantially to that of the wiper element 7. In the assembled position, when the wiper element 7 is in its unstressed state (FIG. 1), the constriction zone 51 is situated substantially in the hour glass-shaped duct 31 of wiper element 7, and in its completely compressed state the wiper lip 32 is still situated opposite the constriction zone 51. Moreover, the diameter of the stem 44 in the constriction zone 51 is slightly smaller than, or at most equal to, the diameter of the opening 32*a* delimited by wiper lip 32 when wiper element 7 is under maximum axial compression.

The brush 45 is constituted by a core 52 coaxial with the stem 44. The core 52 is formed by folding a metallic wire back on itself, then twisting this wire, thus doubled so as to hold around the core 52 a helical row of radial bristles 53. The external diameter of the brush 45, in its state of rest, is substantially constant, except at its free end where it progressively diminishes. However, the minimum external diameter of the brush 45 is slightly larger than that of the opening 32*a* delimited by the wiper lip 32 even before the element 7 reaches its completely unstressed state. Moreover, except in the constriction zone 51, the diameter of the main portion of the stem 44 is slightly larger than, or equal to, that of the opening 32*a* delimited by the internal edge of the lip 32, even before element 7 is subjected to any stress.

The assembly of the make up unit 1 is effected as follows:

Wiper element 7 is first of all inserted into the barrel 4 through the end remote from the neck 10, until an annular surface of the wiper element comes to bear on the shoulder 9 of barrel 4. The adjuster ring 5 is then screwed onto the threaded lower portion 22*c* of reservoir 6 to which the thrust ring 8 has already been fixed by catch-engagement of the bead 29 in groove 38, the upper annular surface of the thrust ring 8 being thereby placed in the same plane as the free edge of the tubular sleeve 22 of the reservoir. The sub-assembly constituted by rings 5 and 8 and the reservoir 6 is then inserted in barrel 4 through its end remote from the neck 10 and is caused to slide in the said barrel 4 until it becomes engaged by the penetration of the bead 12 into groove 20. In this position, the ring 8 and the upper edge of the reservoir 6 are located in a simple leak-proof contact against the lower annular side 34 of the wiper element 7 and the numeral '1' of the indicia in the recessed zone 21 of the upper portion 14*b* of sleeve 14 of ring 5 appears in the window 13 of barrel 4, signifying that the wiper element 7 is in its unstressed state.

In a separate operation, the stem 44 is force-fitted into cap 3 until the flange 49 bears against the set back 41 of the skirt 39, the grooves in the wall 48 at the end of the stem 44 then each accommodating one of the ribs 43 of the cap 3.

The container 2 which has just been assembled is filled with mascara, and the cap 3 and the stem 44 carrying the integral brush 45 are screwed onto the neck 10 of the barrel 4.

This make up unit functions in the following way:

When the brush 45 is being extracted from the reservoir 6 before manipulation of the adjuster ring 5, the wiper lip 32 is located as indicated above in a position where it will ensure a 'minimum force' wiping action, which signifies that the mascara quantity taken up by brush 45 will be the maximum quantity.

If the user wishes to make up with a smaller quantity of mascara on the brush it suffices to turn the adjuster ring 5, aided by the presence of striations 17 on the external wall of sleeve 14, to raise the reservoir 6 so that its upper edge and the thrust ring 8 associated therewith uniformly compress the peripheral ring 32*b* of the wiper element 7. Depending on the amplitude of the turning movement of the adjuster ring 5, there successively appear in the window 13, figures '2'·'3' and '4' which consequently indicate the degree of compression exerted on the resilient ring 32*b* and this corresponds to the increasing force of the wiping action; the quantity of mascara that can be taken up by the brush 45 decreases in inverse proportion to this wiping force.

When the wiper element 7 is being compressed, the concavity of the curved sides which, with the lip 32, delimit the passage 31 through the element 7, is inverted as may be seen by comparing FIGS. 1 and 2, the diameter of the opening 32*a* edged by the lip 32 decreases and the height of the internal edge of the lip 32 increases; however, the said lip 32 does not sustain any damage. Moreover, since the compression is exerted on the ring 32*b*, which is relatively thick, the element 7 as a whole does not show any risk of being damaged even after many manipulations for changing the diameter of opening 32*a*.

The presence of the constriction zone 51 on the stem of brush 44 prevents the lip 32 from being in contact with this stem 44 when cap 3 is in position on container 2, irrespective of the state of compression of the element 7. It has, moreover been seen that the diameter of the stem 44 has been chosen so that the portion of this stem 44 penetrating into the mascara, can also be wiped even in the case where the wiper element 7 is not subjected to any stress.

Finally, one may easily arrange for the amplitude of rotation available for the adjuster ring 5 to be extensive and to correspond in particular to approximately one complete turn: the adjustment of the mascara quantity which can then be taken up on the brush is very fine. In these circumstances, the recessed zone 21 can be replaced by several distinct zones, each carrying a number indicating the degree of compression of element 7.

Figure 6:
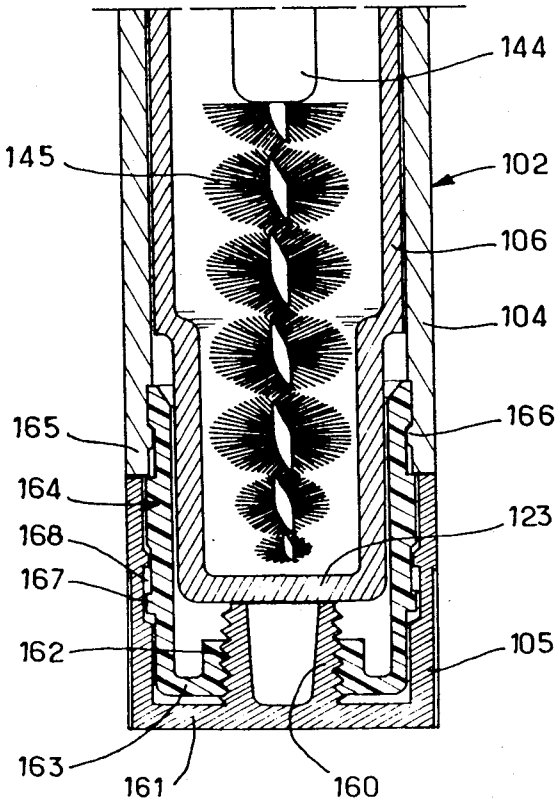
FIG. 6 is a view similar to FIG. 5 of the same make up unit, the wiper element being in a state where it is subjected to compression.
Figure 5:
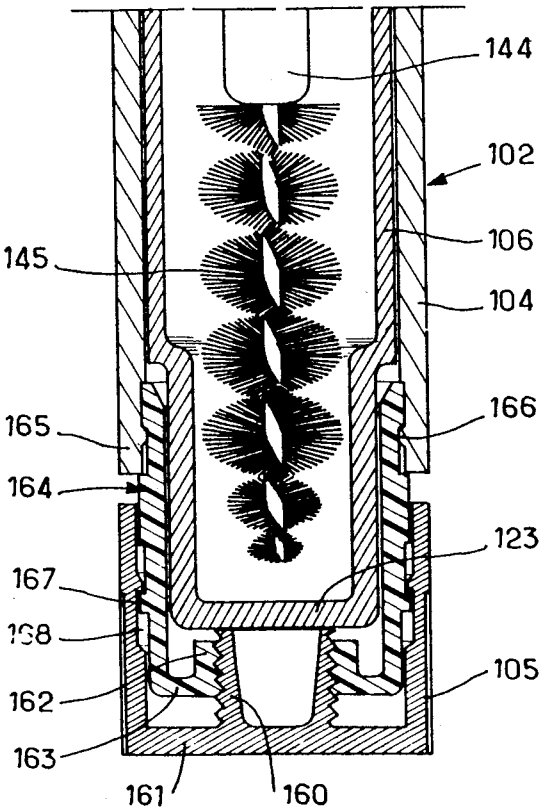
FIG. 5 is an axial cross-sectional view on an enlarged scale of the lower portion of the above mentioned second embodiment of make up unit, the wiper element being in its unstressed state, and the upper portion of this make up unit being strictly identical with that of the make up unit of FIG. 1.

Referring now to FIGS. 5 and 6 relating to a second embodiment of the make up unit according to the invention it will be seen that, as in the above described embodiment, the container 102 is constituted by a cylindrical outer barrel 104 surrounding a reservoir 106 which is slidable within the barrel 104. For the sake of simplicity, similar elements of the first and second embodiments have been designated in the second embodiment by reference numbers increased by 100 over the references used for the first embodiment.

The top part of the make up unit of FIGS. 5 and 6 has not been represented since it is strictly identical with that of the first embodiment. The reservoir 106 contains the make up product which has to be dispensed by means of a brush 145 placed at the end of stem 144 integral with the cap screwed on to the barrel 104.

The bottom end of the outer barrel 104, that is to say, the end which does not carry the cap of the make up unit, is an open end comprising internally a catch engagement bead 166. The free end of a sleeve 164 becomes catch-engaged in this open end of the barrel 104, the open upper portion of the sleeve 164 comprising externally a catch-engagement groove capable of accommodating the catch-engagement ring 166 to ensure the fixing of the sleeve 164 to the base of outer barrel 104. That end of the sleeve 164 which is remote from the barrel 104 comprises a bottom panel 163 in whose central zone is a sleeve having an internal female thread 162. Sleeve 164 has the shape of a cylindrical cup and accommodates internally the bottom portion of the reservoir 106, the said bottom portion having a slightly smaller diameter than the rest of the reservoir 106, to compensate for the thickness of the lateral wall of the sleeve 164.

On the exterior of the sleeve 164 is an adjuster ring 105 constituting a cylindrical cup whose lateral wall is disposed in the extension of the lateral wall of barrel 104. Adjuster ring 105 comprises a bottom panel 161 which comes to be adjacent the bottom panel 163 of sleeve 164. The bottom panel 161 has a coaxial cylindrical projection having an external male thread 160. The end of the male thread 160 which is remote from the connection zone with the bottom panel 161 bears against the bottom panel 123 of the reservoir 106. The male thread 160 cooperates with the female thread 162 so that the adjuster ring 105 can be screwed up to be displaced axially in relation to the sleeve 164 and hence in relation to the outer barrel 104. In the course of such a displacement, the adjuster ring 105 pushes the reservoir 106 inside the barrel 104, moving it translationally towards the wiper element and, as a result, compressing the ring of the said wiper element. Unscrewing movement of the adjuster ring 105 entails an inverse translational movement of the reservoir 106 which is maintained in contact against the end of the male thread 160 by the elastic thrust exerted on it by the wiper element. To avoid any risk of separation of the adjuster ring 105 in relation to the sleeve 164, the sleeve 164 has an external annular rib 167 which is accommodated in an annular recess 168 arranged within, and on the lateral wall of, the adjuster ring 105. The height of the annular recess 168 is sufficient to allow the desired translation of the adjuster ring 105 in relation to sleeve 164. At the time the adjuster ring is positioned on the sleeve 164, the annular rib 167 becomes placed in the annular recess 168 by elastic deformation of the side wall of the adjuster ring 105.

This second embodiment of the control means for compressing of the wiper element by translation of the reservoir in relation to the barrel, has the advantage of great simplicity in manufacture and assembly. The advantages defined for the first embodiment are retained in this second embodiment.

The make up unit described above may include marking means to represent visually the degree of compression of the wiper element, for example indicia applied by the hot marking technique. FIGS. 7 and 8 show a unit similar to that of FIGS. 5 and 6 comprising such marking means obtained in a particularly simple way, without relying on the hot marking technique. The elements of the unit of FIGS. 7 and 8 which are similar to those of the unit of FIGS. 5 and 6 have been designated by reference numbers increased by 100 in relation to those used for this last unit.

The outer barrel 204 is identical with barrel 104, with the exception that its lower edge comprises a channel-shaped cut out 269, of small height and small width for a function to be indicated below.

The sleeve 264 also has a structure which is substantially identical with that of sleeve 164; however, with this third embodiment it must necessarily be of a different colour from the barrel 204. The sleeve 264, also made of a plastic material but having a colour different from that of the barrel 204, is constituted by a cylindrical skirt 270 joined to a bottom panel 263 having a central opening edged by a cylindrical skirt 271 directed inside the sleeve 264 and carrying internally a female thread 262, but shorter than the cylindrical skirt 270.

The free inner edge 272 of the cylindrical skirt 270 is chamfered so as to facilitate relative sliding between reservoir 206 and sleeve 264 as the make up unit 201 is assembled.

Moreover, the skirt 270 carries externally, near the bottom 263 of the sleeve 264, an annular rib 267. Between this rib 267 and its free edge, the skirt 270 has, successively, an outwardly facing set back substantially at mid-height of the said skirt 270 so as to provide an annular bearing surface 267*a*, then an annular rib 274 situated substantially mid-way between the bearing surface 267*a* and the free edge of skirt 270. Immediately above its rib 274, the skirt 270 has a thickness substantially identical to that of its lower portion and then, from a point situated near the free edge, the thickness of skirt 270 again increases so as to constitute an annular bead 273 allowing the sleeve 264 to be engaged in the open end of barrel 204, bead 273 then becoming positioned behind a peripheral catch-engagement ring 212 at the lower end of the outer barrel 204.

The annular rib 274 comprises, towards the free edge of skirt 270, an appendage which is disposed perpendicular to the said rib 274 and which constitutes a boss 275 capable of becoming accommodated in the cut out 269 in the lower edge of barrel 204 in the assembled position of the make up unit 201.

The adjuster ring 205, which closes unit 201 at its bottom portion, is also substantially identical with the ring 105; its colour must, however, be different from that of sleeve 264. It is constituted by a cylindrical skirt 276 joined to a bottom panel 261 having an external diameter substantially equal to that of the barrel 204 and having a coaxial cylindrical projection 277 with an external male thread 260. In the assembled position of the make up unit 201, bottom panel 261 of the adjuster ring 205 comes to be adjacent the bottom panel 263 of the sleeve 264, and the male thread 260 cooperates with the female thread 262. The free edge of the projection 277 bears against the bottom 223 of the reservoir 206 which is described below. Thus, by screwing, the adjuster ring 205 can be displaced axially in relation to the sleeve 264 and hence in relation to the barrel 204.

To avoid any risk of separation of the adjuster ring 205 from the sleeve 264, there is an annular recess 268 within the skirt 276 of adjuster ring 205. This recess 268, whose height is sufficient to permit the desired translation of the adjuster ring 205 in relation to the sleeve 264 serves as a housing for the annular rib 267 of the sleeve 264.

To facilitate its manipulation, the adjuster ring 205 has external axial striations 278 over approximately $\frac{2}{3}$ of its height, starting from its bottom 261.

Moreover, near the free edge of the skirt 276, in its non-striated portion and above the recess 268, are three circular openings 279, 280 and 281 whose centres are disposed in the same plane perpendicular to the axis of adjuster ring 205 and whose diameters increase from one opening to the next along the series.

The outer barrel 204 and the sleeve 264 delimit an internal space accommodating the reservoir 206 which is identical with reservoir 106 and consists of a tubular sleeve 222 joined at its base to a bottom 223 and is open at its upper portion. The tubular sleeve 222 comprises, between its free edge and its bottom 223, an upper cylindrical portion 222*a* whose external diameter is slightly smaller than the internal diameter of barrel 204, then in its lower zone a cylindrical portion 222*b* of smaller diameter so as to make it possible to compensate for the thickness of the lateral wall of the sleeve 264; the portions 222*a* and 222*b* are joined by a frusto-conical shoulder 222*c* flaring towards the free opening of the reservoir 206.

Near its free edge, the inner wall of portion 222*a* of the reservoir 206 comprises an annular bead 229, above which it has an annular set back 230 towards the outside.

The wiper element 207, thrust ring 208, cap 203, stem 245 and brush 244 are all strictly identical with those of the first embodiment described.

The assembly of the make up unit 201 is effected like that of unit 101.

If the adjuster ring 208 is screwed right up, as is the case in FIG. 8, the rib 267 bears against that edge of the recess 268 which is next to the bottom panel 261 of the adjuster ring 205 and the free edge of the adjuster ring comes to be near the rib 274 of sleeve 264.

Moreover, when the adjuster ring 205 is in position on the sleeve 264 it is possible to see, through the openings 279, 280 and 281, the colour of the sleeve 264 which, as has been indicated above, is different from that of the adjuster ring 205. There are thus constituted three marks whose function will be described below.

When the sub-assembly constituted by the sleeve 264 and the adjuster ring 205 is inserted into the barrel 204 through its opening at the end remote from the neck 210 and when it is pushed along the barrel 204 until it is engaged by means of the bead 273 of sleeve 264 passing behind the bead 212 of the barrel 204, the boss 275 of sleeve 264 enters the cut out 269 of the barrel 204. Since the barrel 204 and sleeve 264 have different colours, a mark is thus indicated whose function is also indicated below.

If sleeve 264 is completely screwed down within the adjuster ring 205, the boss 275 is situated directly above the smallest diameter opening 279 and the wiper element 207 is in the state of maximum axial compression which is the case in FIG. 8. In fact, in this position, the free end of the projection 277 of the adjuster ring 205 has pushed the reservoir 206 hard up inside the barrel 204 towards the wiper element 207, and, as a result, achieved the maximum compression of the ring 232*b* of the wiper element 207.

Unscrewing movement of the adjuster ring 205 entails the inverse translational movement of the reservoir 206 which is held constantly against the free end of the projection 277 by the elastic thrust exerted on it by the resilient wiper element 207.

In this unscrewing movement, first the opening 208 of medium diameter and then the opening 281 of the largest diameter successively arrive directly below the boss 275 to indicate that the wiper element 207 is situated respectively in a position of a medium axial compression and then in a minimum axial compression position.

Subsequently, the thus assembled container 202 is filled with mascara, and then the cap 203 with stem 244 and brush 245 fastened thereto becomes fixed by screwing onto the neck 210 of the barrel 204.

This make up unit works as follows:

When the brush 245 is being extracted from the reservoir 206, with the adjuster ring 205 situated in a position such that the opening 281 is situated below the boss 275, the wiper lip 232 is in a position wherein it will ensure a minimum force wiping action, corresponding to the mascara quantity taken up by the brush being at its maximum. The user thus associates the idea of the greatest diameter opening 281 with a maximum opening of the wiper lip 232 and hence with a make up action using a considerable quantity of mascara.

If the user intends to make up by means of the brush less heavily charged with mascara, he or she simply turns the adjuster ring 205, aided by the presence of striations 278 on the external wall 276 of ring 205, to cause the reservoir 206 to ascend vertically so its upper edge and thrust ring 208 uniformly compress the peripheral ring 232*b* of the wiper element 207. Depending on the amplitude of the turning movement of the adjuster ring 205, there will successively appear opposite the boss 275 firstly the opening 280 with a medium diameter, and secondly the opening 279 with a small diameter, indicating respectively that the mascara quantity which can be taken up on brush 245 diminishes proportionately, taking into account the increasing force of the wiping action.

It shall be duly understood that the embodiments described above are in no way restrictive and may give rise to any desirable modifications without thereby departing from the spirit and scope of the invention.

I claim:

1. In a make up unit for dispensing eyelash make up comprising:

(a) a container for a fluid or pasty make up product, said container having an inlet;

(b) a detachable cap fitted on the container;

(c) a stem coaxial with said cap and having a proximal end integral with said cap, said stem projecting in relation to said cap;

(d) a brush carried by the distal end said stem as an extension of the said stem;

(e) a wiper element having a wiper lip made of an elastic material and disposed at the inlet of said container into which said brush enters, said wiper element including means defining a passage delimited by the inner edge of the wiper lip, said passage having a smaller cross-section than the cross-section of the brush in the undeformed state of the brush;

the improvment wherein said wiper element further includes a ring made of an elastic material joined to the periphery of the wiper lip, said ring having a greater thickness than said lip, and wherein said wiper element is capable of sustaining an elastic deformation leading to a variation of cross-section of the passage under the actuation of control means which varies the axial compression of said elastic ring;

said container being constituted by a movable element and a fixed element between which said ring of the wiper element is interposed, the movable element being capable of axial translation in relation to the fixed element and being connected to the control means;

said container including a neck and a tube formed therewith, the fixed element of the container being constituted by a tube joined to said neck at its end remote from the end cooperating with the control means, said neck and said cap comprising complementary first and second means for fitting the cap on said neck, the connection of said tube to said neck constituting an annular shoulder against which the wiper element bears.

2. A make up unit according to claim 1, wherein the wiper element is constituted by a single component having a transverse centre plane, in the vicinity of which the wiper lip is disposed.

3. A make up unit according to claim 1, wherein the ring has curved inner faces and end planes which in the relaxed state of the ring are concave towards the axis of the passage provided for the brush, said curved walls joining the wiper lip to the end planes of the ring.

4. A make up unit according to claim 1, wherein said passage delimited by the wiper lip, when the wiper element is in its unstressed state, has a cross-section no greater than that of the portion of stem which penetrates into the container through said passage.

5. A make up unit according to claim 1, wherein in the assembled position of the cap on the container, the stem of the brush has a reduced cross-section in its zone situated in said passage of the wiper element.

6. A make up unit according to claim 1, including means for indicating the degree of compression exerted on the wiper element.

7. In a make up unit for dispensing eyelash make up comprising:

(a) a container for a fluid or pasty make up product, said container having an inlet;

(b) a detachable cap fitted on the container;

(c) a stem coaxial with said cap and having a proximal end integral with said cap, said stem projecting in relation to said cap;

(d) a brush carried by the distal end of said stem as an extension of the said stem;

(e) a wiper element having a wiper lip made of an elastic material and disposed at the inlet of said container into which said brush enters, said wiper element including means defining a passage delimited by the inner edge of the wiper lip, said passage having a smaller cross-section than the corss-section of the brush in the undeformed state of the brush;

the improvement wherein said wiper element further includes a ring made of an elastic material joined to the periphery of the wiper lip, said ring having a greater thickness than said lip, and wherein said wiper element is capable of sustaining an elastic deformation leading to a variation of cross-section of the passage under the actuation of control means which varies the axial compression of said elastic ring;

said container being constituted by a movable element and a fixed element between which said ring of the wiper element is interposed, the movable element being capable of axial translation in relation to the fixed element and being connected to the control means;

said movable element carrying internally, along its upper edge, a thrust ring which both ensures the seal between the said movable element and wiper element and distributes the compressive force applied against the ring of said wiper element.

8. In a make up unit for dispensing eyelash make up comprising:

(a) a container for a fluid or pasty make up product, said container having an inlet;

(b) a detachable cap fitted on the container;

(c) a stem coaxial with said cap and having a proximal end integral with said cap, said stem projecting in relation to said cap;

(d) a brush carried by the distal end of said stem as an extension of the said stem;

(e) a wiper element having a wiper lip made of an elastic material and disposed at the inlet of said container into which said brush enters, said wiper element including means defining a passage delimited by the inner edge of the wiper lip, said passage having a smaller cross-section than the cross-section of the brush in the undeformed state of the brush;

the improvment wherein said wiper element further includes a ring made of an elastic material joined to the periphery of the wiper lip, said ring having a greater thickness than said lip, and wherein said wiper element is capable of sustaining an elastic deformation leading to a variation of cross-section of the passage under the actuation of control means which varies the axial compression of said elastic ring;

said container being constituted by a movable element and a fixed element between which said ring of the wiper element is interposted, the movable element being capable of axial translation in relation to the fixed element and being connected to the control means;

said make up unit further including a reservoir constituting said movable element of the container, said reservoir having a cylindrical base, an upper edge which exerts a thrust on the wiper element; a barrel of the container surrounding the reservoir and constituting the fixed element of the container; an adjuster ring constituting the control means and being mounted for integral translation with said barrel; and complementary first and second threads externally on the cylindrical base of said reservoir and internally of said adjuster ring.

9. A make up unit according to claim 8, wherein the barrel comprises, along its edge on the opposite end remote from the wiper element, means for engaging the adjuster ring.

10. A make up unit according to claim 8, including means for indicating the degress of compression exerted on the wiper element, and a window of the barrel; and wherein the adjuster ring has a cylindrical wall comprising, on its external surface, a succession of marks which are disposed radially and which appear in turn in the window of the barrel when said adjuster ring is being turned, said cylindrical wall penetrating inside the barrel.

11. A make up unit according to claim 8, wherein said barrel has a lateral wall and said adjuster ring has a lateral wall and said lateral wall of said barrel and the lateral wall of said adjuster ring are flush with one another.

12. In a make up unit for dispensing eyelash make up comprising:

(a) a container for a fluid or pasty make up product, said container having an inlet;

(b) a detachable cap fitted on the container;

(c) a stem coaxial with said cap and having a proximal end integral with said cap, said stem projecting in relation to said cap;

(d) a brush carried by the distal end of said stem as an extension of the said stem;

(e) a wiper element having a wiper lip made of an elastic material and disposed at the inlet of said container into which said brush enters, said wiper element including means defining a passage delimited by the inner edge of the wiper lip, said passage having a smaller cross-section than the cross-section of the brush in the undeformed state of the brush;

the improvement wherein said wiper element further includes a ring made of an elastic material joined to the periphery of the wiper lip, said ring having a greater thickness than said lip, and wherein said wiper element is capable of sustaining an elastic deformation leading to a variation of cross-section of the passage under the actuation of control means which varies the axial compression of said elastic ring;

said container being constituted by a movable element and a fixed element between which said ring of the wiper element is interposed, the movable element being capable of axial translation in relation to the fixed element and being connected to the control means;

said make up unit further including a reservoir constituting the movable element of the container, said reservoir having an upper edge for exerting a thrust on the wiper element; a barrel of the container constituting the fixed element of the container, said barrier surrounding the reservoir; an adjuster ring constituting the control means, said adjuster ring and said reservoir having cooperating first and second threads of which said second thread is in the zone of said container which is remote from that receiving the cap, said adjuster ring abutting against the bottom of the reservoir.

13. A make up unit according to claim 12 wherein the adjuster ring constitutes a cylindrical cup having a bottom, a projecting male threaded member coaxial with the cup and abutting against the bottom of the reservoir, and within the cup, and forming part of said cup bottom, a female threaded member in engagement with said barrel and cooperating with said male member abutting against said bottom of the reservoir.

14. A make up unit according to claim 13, wherein the female threaded member is in the form of a sleeve which is fixed on that one of the ends of the barrel which is remote from said cap, said end being open.

15. A make up unit according to claim 13, wherein the female member is carried by the bottom of a sleeve which is fixed on that one of the ends of the barrel which does not receive the cap, said end being open, and wherein the sleeve is coloured differently from the adjuster ring and the barrel and constitutes said subjacent element forming, with said opening and the opening means in the barrel and in the adjuster ring, respectively, the first and the second marks.

16. A make up unit according to claim 15, wherein the fixed element comprises the opening forming the first mark and the adjuster ring comprises the opening means forming the second marks, wherein said opening forming the first mark is constituted by a cut out of the rim of the barrel at the end remote from that receiving the cap, and wherein the sleeve carries a protuberance capable of being accommodated in the said cut out.

17. In a make up unit for dispensing eyelash make up comprising:

(a) a container for a fluid or pasty make up product, said container having an inlet;

(b) a detachable cap fitted on the container;

(c) a stem coaxial with said cap and having a proximal end integral with said cap, said stem projecting in relation to said cap;

(d) a brush carried by the distal end of said stem as an extension of the said stem;

(e) a wiper element having a wiper lip made of an elastic material and disposed at the inlet of said container into which said brush enters, said wiper element including means defining a passage delimited by the inner edge of the wiper lip, said passage having a smaller cross-section than the cross-section of the brush in the undeformed state of the brush;

the improvement wherein said wiper element further includes a ring made of an elastic material joined to the periphery of the wiper lip, said ring having a greater thickness than said lip, and wherein said wiper element is capable of sustaining an elastic deformation leading to a variation of cross-section of the passage under the actuation of control means which varies the axial compression.of said elastic ring;

said container being constituted by a movable element and a fixed element between which said ring of the wiper element is interposed, the movable element being capable of axial translation in relation to the fixed element and being connected to the control means;

said make up unit further including means for indicating the degree of compression exerted on the wiper element, wherein the control means is an adjuster ring, and the means for indicating the degree of compression of the wiper element comprising:

(i) a first mark formed by means defining an opening in the lateral wall of one of the fixed element and the adjuster ring, said opening exposing a subjacent element which is of a different color from the part carrying the said first mark; and (ii) several second marks each formed by opening means in the lateral wall of the other of said fixed element and adjuster ring which does not carry the first mark, said opening exposing a subjacent element which is of a different color from that of said other of the fixed element and adjuster ring carrying said second marks, each of said second marks being capable of coming to a position opposite the first mark for a given position of the adjuster ring.

18. A make up unit according to claim 17, wherein the fixed element comprises the opening forming the first mark and the adjuster ring comprises the opening means forming the second marks.

19. A make up unit according to claim 17, wherein the opening means forming the second marks have differing parameters.

20. A make up unit according to claim 19, wherein the parameters of holes forming the second marks are associated with the state of compression of the wiper element.

21. A make up unit according to claim 19, wherein the opening means forming the second marks have circular shapes.

22. A make up unit according to claim 17, wherein the opening means forming the second marks have axes which are disposed in the same plane perpendicular to the axis of rotation of the adjuster ring.

23. A make up unit according to claim 17, where in there are three of said opening means forming the second marks.

* * * * *